US006698642B2

(12) United States Patent
Chen

(10) Patent No.: US 6,698,642 B2
(45) Date of Patent: Mar. 2, 2004

(54) WIRE RETAINER CASING

(76) Inventor: Tung-I Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/164,389

(22) Filed: Jun. 10, 2002

(65) Prior Publication Data

US 2003/0226875 A1 Dec. 11, 2003

(51) Int. Cl.[7] ..... B25C 5/10

(52) U.S. Cl. ..... 227/120; 227/8; 227/132; 227/123; 227/152; 227/153

(58) Field of Search ..... 227/120, 28, 29, 227/31, 123, 152, 153

(56) References Cited

U.S. PATENT DOCUMENTS 2,668,290 A * 2/1954 Heller ..... 227/132
4,087,035 A * 5/1978 Harmon ..... 227/120
4,380,312 A * 4/1983 Landrus ..... 227/116
4,552,296 A * 11/1985 Sheng ..... 227/109
4,801,061 A * 1/1989 Mangone, Jr. ..... 227/120
4,805,824 A * 2/1989 Erickson ..... 227/120
5,884,829 A * 3/1999 Wingert ..... 227/151
6,082,604 A * 7/2000 Dennis ..... 227/8

* cited by examiner

*Primary Examiner*—John Sipos
*Assistant Examiner*—Michelle Lopez
(74) *Attorney, Agent, or Firm*—Leong C. Lei

(57) ABSTRACT

The present invention relates to a wire retainer of a stapler that is applicable for stapling objects with different staple size, and such stapler comprises a groove bracket being disposed at the bottom edge between two side casings for accommodating the staples; a staple roller assembly being disposed on the groove bracket; a staple plate being disposed at the front edge of the side casing for shooting the staple; characterized in that: a detachable wire retainer being disposed at the front edge of the staple plate of the stapler such that the user can switch the wire retainer of different specifications, and maintain a smooth and stable stapling working surface for different stapler specifications without a need of switching the stapler. The present invention effectively improves the current existing stapler that can only fit a single specification to attain the purpose of convenient operation.

1 Claim, 5 Drawing Sheets

WIRE RETAINER CASING

BACKGROUND OF THE INVENTION (a) Field of the Invention

The present invention is related to a wire retainer casing, and more particularly, to a wire retainer that fit staplers of different specifications.

(b) Description of the Prior Art

As to the construction of regular wire (such as electric wire, information wire, etc), since the length and flexibility of the wire itself cannot be effectively pressed against or fixed on an attaching plane, therefore the "n"-shaped staple is generally used to fix the wire in position. With the consideration of the stapling speed for the development of staplers and the effective positioning of stables, the stapler generally has a "n"-shape roller guide corresponsive to the staple exit protruded from the bottom of the stapler, such that the wire can be fixed into position by using the opening at the center of the roller guide.

Since the diameter and shape of different wires are not the same, therefore the safety and stability of the stapler are taken into consideration, and the general staple can overcome the problem of different specifications. On the contrary, the stapler itself only has an opening of one size. Therefore if the diameter of the wire is smaller than the opening on the roller guide, the stapler will lose the positioning function; if the diameter of the wire is larger than the opening on the roller guide, the protruded post on both side of the roller guide cannot press against the construction plane causing the instable condition and inconvenience during the stapling operation.

In summation of the above description, we can understand that since the design of current stapler is not perfect, and unable to fit the wires of different specifications, it may impact the economic benefit. In addition, the frequent switching of staplers also affects the convenience of the operation, therefore it cannot really solve the problem, and further improvement is needed.

SUMMARY OF THE INVENTION

The present invention is related to a wire retainer casing, and more particularly, to a wire retainer that fit staplers of different specifications.

The primary purpose of the present invention is to provide a wire retainer casing for the stapler that can fit wires of different sizes and specifications.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

To attain the foregoing purpose, the present invention can be implemented by the following technological means: the stapler comprising a groove bracket being disposed at the bottom edge between two side casings for accommodating the staples; a staple roller assembly being disposed on a groove bracket for pushing the staple forward; a staple plate being disposed at the front edge of the side casing for shooting the staple; characterized in that: an embedded groove, being disposed at the front edge of the side casing of the stapler, for switching the wire retainer, and a wire opening being disposed at the center of the bottom of the wire retainer, and the wire opening of the wire retainer fits the shape and specification according to the shape and specification of the wire, and the height from the inner top surface of the wire opening of the wire retainer to the top of different wire retainers is the same; thereby, the user can switch wire retainer of different specifications according to the actual needs, and the present invention can successfully press against the working surface in a stable condition and is applicable for the wire of different diameters and specifications without switching to different staplers. The present invention further improves the current existing stapler that can only fit one kind of wire and is very inconvenient in order to attain the purpose of improving the convenience.

Figure 1:
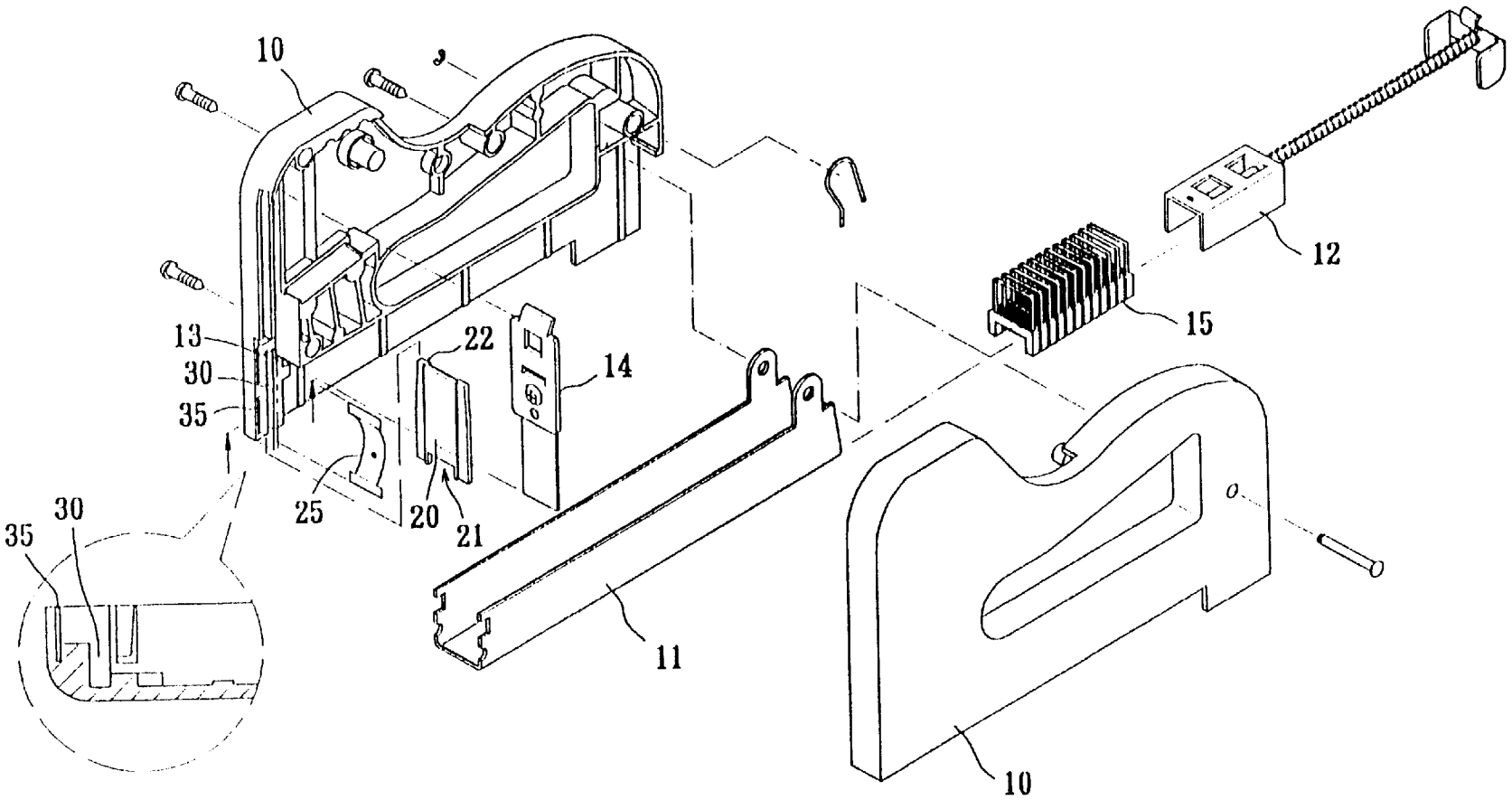
FIG. 1 is a schematic diagram of the stapler according to the present invention, demonstrating the configuration of each component and their corresponsive relations.
Figure 2A:
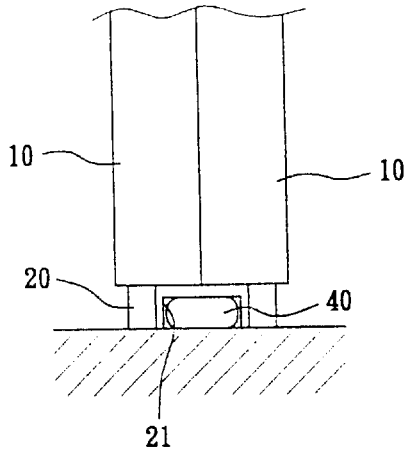
FIG. 2A is a reference schematic diagram showing the front view of the present invention when it is in use.
Figure 2B:
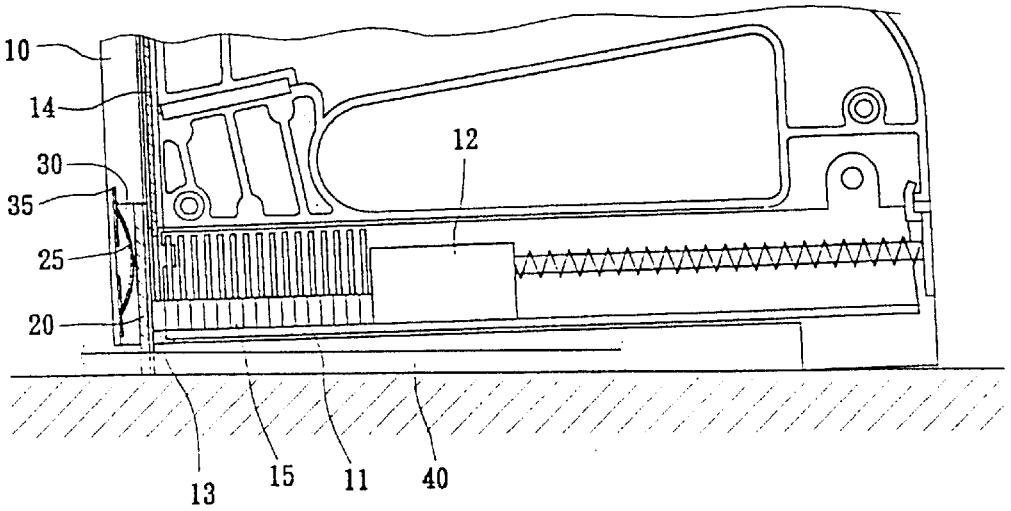
FIG. 2B is a cross-sectional side view of FIG. 2A.
Figure 3A:
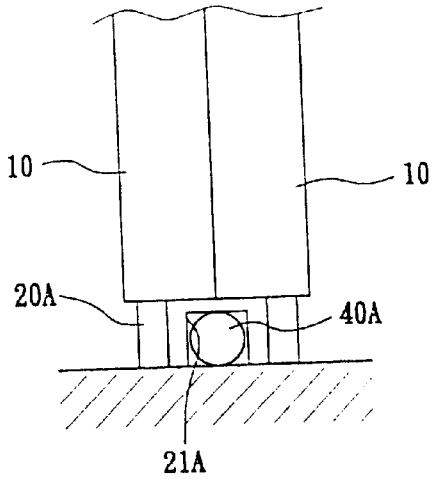
FIG. 3A is another reference schematic diagram showing the front view of the present invention.
Figure 3B:
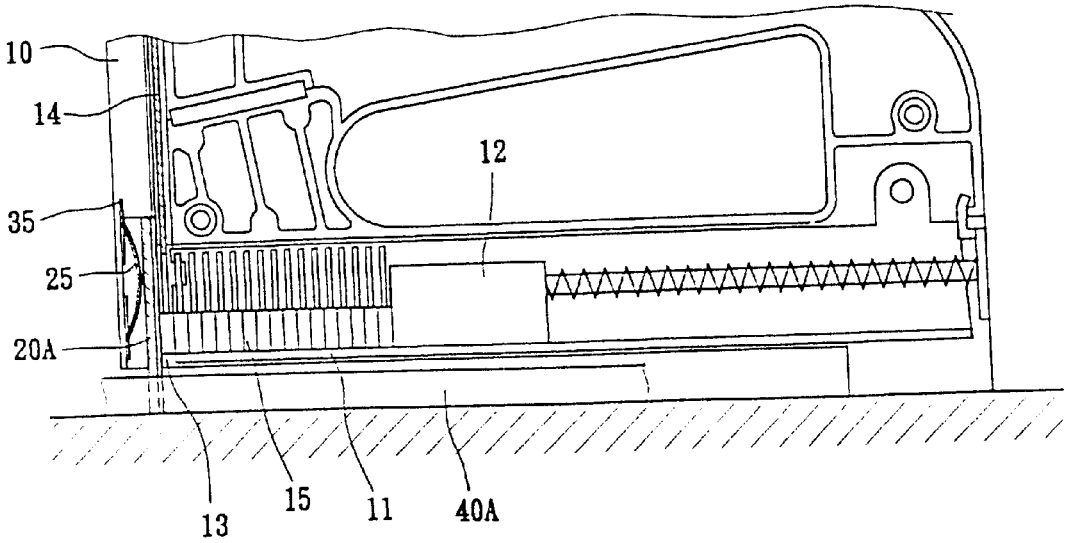
FIG. 3B is another cross-sectional side view of FIG. 3A.
Figure 4A:
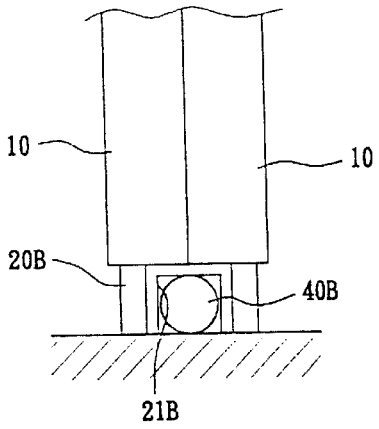
FIG. 4A is another reference schematic diagram showing the front view of the present invention.
Figure 4B:
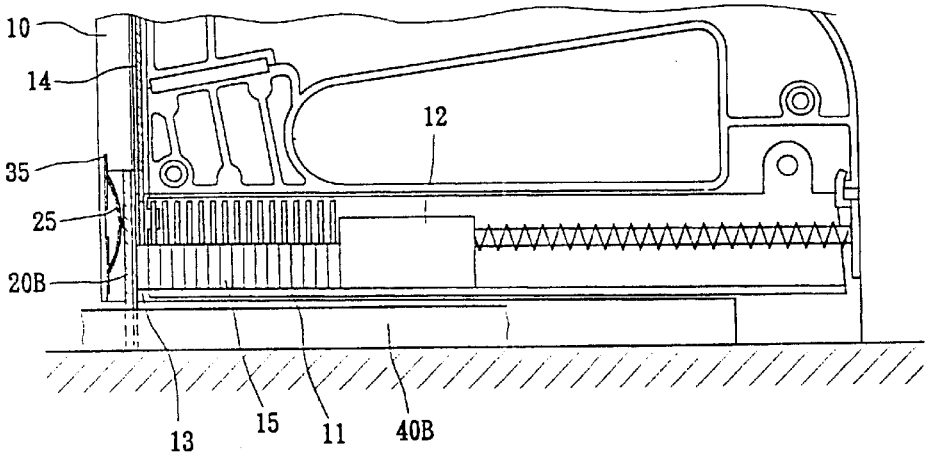
FIG. 4B is a cross-sectional side view of FIG. 4A.

The present invention relates to a wire retainer casing that can fit the wires of different sizes and specifications. In FIGS. 1, 2A and 2B, the stapler mainly comprises two corresponsive side casings 10, wherein a groove bracket 11 disposed at the bottom of the side casing 10; a staple roller assembly 12 disposed on the groove bracket for pushing the stables forward, and a staple groove 13 disposed at the front edge of the side casing 10 and vertically to the groove bracket 11; a staple pate 14 disposed in the staple groove 13 for shooting a staple 15. The structure and principle of movement of the foregoing stapler are the same as those in the prior art, and not the characteristics of the present invention, thus will not be described in details here.

The characteristics of the present invention will be described together with FIGS. 1, 2A and 2B. The stapler according to the present invention has a switching wire retainer 20 at the front edge of the side casing for holding wire 40 of different specifications by switching to different wire retainers.

Figure 5:
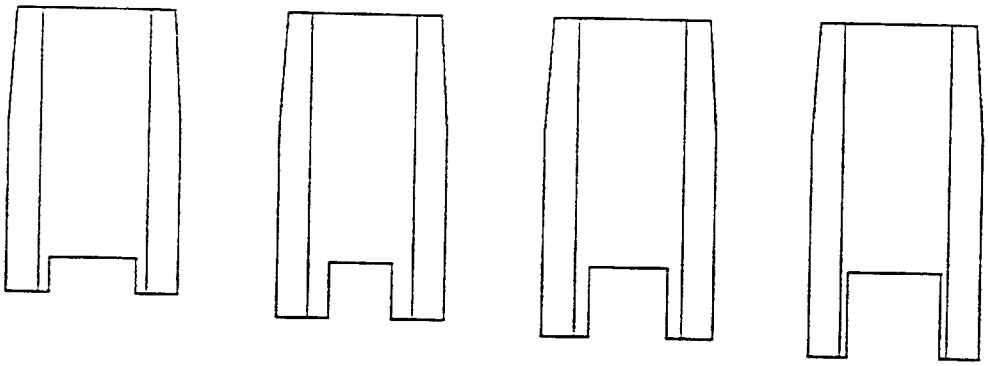
FIG. 5 is a planar schematic diagram of each of the wire retainer of the present invention.

The detailed structure of the present invention comprises a wire retainer 20 in the form of a plate, and such wire retainer 20, has a wire retaining opening 21 at its bottom facing downward, and as shown in FIG. 5, the wire retaining opening 21 of the wire retainer 20 extends downward. In other words, the height from the inner top edge of the wire retaining opening of different specifications to the top of the wire retainer 20 is the same such that it can fit the wire 40 of different specifications. Further, a flange 22 is disposed on each side of the staple plate 14 corresponsive to the wire retainer 20, and the two flanges 22 can be used to press against both of the sides for stapling and avoid the contact point at the central part of the staple 15 to enhance the smoothness of shooting the staple 15.

Further, an embedded groove 30 for accommodating the wire retainer 20 is disposed at the front end of the staple groove 13 on both side of the casing 10 of the stapler, and a corresponsive retaining groove 35 is disposed at each of the upper and lower section of the embedded groove 30 of the casing 10, and the two retaining grooves 35 has a latching bracket 25 being extended in curve into the wire retainer 20 in order to secure it into the embedded groove 30 of the casing 10 (screws can also be used to secure the wire retainer 20 from the front of the casing). Such arrangement constitutes a switchable, easy-to-use wire retainer for a stapler.

Referring to FIGS. 2A, 2B, 3A, 3B, 4A and 4B for the actual usage of the present invention. When the user needs to staple a flat wire 40, a wire retaining opening with flat shape should be used and the size should match with that of the wire retainer (as shown in FIGS. 2A and 2B), and the wire retainer 20 is inserted into the embedded groove 30 of the casing 10 on both sides such that the top of the wire retainer 20 presses against the top edge of the embedded groove 30, and in the meantime, the latching bracket 25 tightly presses against the wire retainer 20 in order to attain the purpose of fixing the wire retainer 20 into position. The user can secure the staple 15 into position according to the positioning wire on the wire retainer 20 on the stapler.

If the wires 40A, 40B are of different diameters, the corresponding wire retainer 20A, 20B can be selected for use. The user just needs to detach the original wire retainer 20 and switch it with the wire retainers 20A, 20B by insert them into the embedded groove 30 of the stapler, and then wires 40A, 40B of different specifications can be clipped. There is no problem of position or securing the retainers at all, and the user only need to prepare a stapler for the use in different occasions.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A wire retainer of a stapler, said stapler comprising a groove bracket disposed at the bottom edge between two side casings for accommodating a staple; a staple roller assembly disposed on a groove bracket for pushing the staple forward; a staple plate disposed at the front edge of the side casings for shooting the staple; wherein an embedded groove is disposed at the front edge of the side casings of the stapler for switching the wire retainer, a wire opening is disposed at the center of the bottom of the wire retainer, the wire opening of the wire retainer fits the shape and specification according to the shape and specification of the wire, and a height from an inner top surface of the wire opening of the wire retainer to a top of different wire retainers is the same, the wire retainer has a flange protruded from both sides of the staple plate corresponsive to the wire retainer, said side casings having a corresponsive retaining groove, disposed on the upper and lower sections in the front of the embedded groove of the side casings, and said retainer grooves having a latching bracket protruded in curve into the wire retainer for retaining the wire retainer such that the wire retainer is retained by the latching bracket.

* * * * *